US008006418B2

(12) United States Patent
Kobayashi

(10) Patent No.: US 8,006,418 B2
(45) Date of Patent: Aug. 30, 2011

(54) PATTERN DISPLAY IMPLEMENT AND CONTAINER WITH SCREEN PART

(75) Inventor: Toshiya Kobayashi, Tokyo (JP)

(73) Assignee: Suntory Holdings Limited, Osaka (JP)

( * ) Notice: Subject to any disclaimer, the term of this patent is extended or adjusted under 35 U.S.C. 154(b) by 0 days.

(21) Appl. No.: 11/791,791

(22) PCT Filed: Nov. 28, 2005

(86) PCT No.: PCT/JP2005/021827

§ 371 (c)(1),
(2), (4) Date: Apr. 26, 2008

(87) PCT Pub. No.: WO2006/059581

PCT Pub. Date: Jun. 8, 2006

(65) Prior Publication Data

US 2009/0113773 A1 May 7, 2009

(30) Foreign Application Priority Data

Nov. 30, 2004 (JP) ..... 2004-347269

(51) Int. Cl.
*G09F 19/14* (2006.01)

(52) U.S. Cl. ..... 40/453; 40/488; 446/147; 446/219

(58) Field of Classification Search ..... 40/453, 40/436, 488, 486; 446/151, 147; 434/402
See application file for complete search history.

(56) References Cited

U.S. PATENT DOCUMENTS 4,263,737 A * 4/1981 Simon ..... 40/453
5,494,445 A 2/1996 Sekiguchi et al.
5,525,383 A 6/1996 Witkowski
5,695,346 A * 12/1997 Sekiguchi et al. ..... 434/365
6,385,882 B1 * 5/2002 Conley et al. ..... 40/454
6,581,972 B2 * 6/2003 Nojima et al. ..... 283/81

FOREIGN PATENT DOCUMENTS

| | | |
|---|---|---|
| JP | Y1-29-10139 | 8/1954 |
| JP | Y1-35-18817 | 8/1960 |
| JP | U-3028589 | 6/1996 |
| JP | U-3095265 | 4/2003 |
| WO | WO 01/78049 | 10/2001 |

OTHER PUBLICATIONS

PCT International Search Report mailed on Dec. 20, 2005 for the corresponding International patent application No. PCT/JP2005/021827.

Extended European Search Report dated Oct. 12, 2010 for European patent application No. 05809519.1-2214.

* cited by examiner

*Primary Examiner* — Joanne Silbermann
*Assistant Examiner* — Kristina Staley
(74) *Attorney, Agent, or Firm* — Posz Law Group, PLC

(57) ABSTRACT

A plurality of patterns 40*a* through 40*e* comprising a plurality of plotting lines 41*a* to 41*e* of a predetermined width drawn parallel to each other at predetermined intervals and drawn inclined with respect to the axial direction of a can 3 are provided in staggered positions at intervals corresponding to the width of the plotting lines 2. Meanwhile, a plurality of linear opaque portions 21 of a predetermined width alternating with a plurality of linear transparent portions 22 of a predetermined width are provided parallel to each other on a cylindrical heat-shrink film 1 at an inclination angle corresponding to the angle of the plotting lines 41*a* through 41*e* on the can 3. This cylindrical heat-shrink film 1 is then mounted on the outside of the can 3. In this way, a container with screen part on which the pattern can be changed is provided in a way not possible before.

12 Claims, 3 Drawing Sheets

PATTERN DISPLAY IMPLEMENT AND CONTAINER WITH SCREEN PART

TECHNICAL FIELD

The present invention relates to a pattern display implement capable of displaying a pattern with changes, and to a container equipped with a screen part capable of displaying a pattern with changes.

BACKGROUND ART

Utility Model Registration No. 3095265 discloses a packaging container that allows a pattern seen on the surface of the container to be altered by sliding a top film to thereby sequentially expose any of the linear graphic parts making up linear patterns through the linear transparent portions of the top film. The packaging container itself may comprise a rectangular container body having a lid that fits detachably into a top opening in the container body, or may comprise a cylindrical container body having a bottom, and in the first case the linear graphic parts and the top film are provided on the flat part of the lid, while in the second case the linear graphic parts and the top film are provided on the outer circumference surface of the container body.

DISCLOSURE OF THE INVENTION

Problem to be Solved by the Invention

However, in the packaging container described in Utility Model Registration No. 3095265 the top film can only slide perpendicular to the direction of the lines in the linear graphic part on the container surface.

The present invention has been devised in view of the above state of affairs; it is an object of the present invention to provide a pattern display implement and a container with screen part wherein the pattern can be altered in a different way from before.

Means for Solving the Problem

To attain the above object, firstly, the present invention provides a pattern display implement comprising a base part and a screen part capable of sliding vertically and/or horizontally on the surface of the base part, wherein a plurality of patterns comprising a plurality of plotting lines of a predetermined width drawn parallel to each other at predetermined intervals and drawn inclined with respect to the sliding direction (vertical and/or horizontal direction) of the screen part are provided in staggered positions on the surface of the base part at intervals corresponding to the width of the plotting lines, and wherein a plurality of linear masking portions of a predetermined width alternating with a plurality of linear viewing portions of a predetermined width are provided parallel to each other on the screen part at an inclination angle corresponding to an inclination angle of the plotting lines on the base part (Invention 1).

In the pattern display implement of the above invention (Invention 1), because the plotting lines of the pattern and the masking portions and viewing portions of the screen part are at an inclination angle with respect to the sliding directions (vertical and/or horizontal direction) of the screen part, a plurality of patterns can be sequentially displayed through the viewing portions of the screen part whether the screen part is slid in a vertical or horizontal direction on the surface of the base part. This pattern display implement is interesting in changing patterns and very entertaining.

In the above invention (Invention 1), the base part may be cylindrical or columnar, and the screen part may be provided on a cylindrical member which is attached to the outer circumference surface of the base part so as to be able to slide in the circumferential direction and/or in the axial direction of the base part (Invention 2).

With the above invention (Invention 2), a simple configuration allows a screen part to be slid vertically and/or horizontally on the surface of a base part.

In the above invention (Invention 2), the cylindrical member may be formed from a film, and may be capable of sliding in contact with the outer circumference surface of the base part (Invention 3).

With the above invention (Invention 3), a further simple configuration allows a screen part to be slid vertically and/or horizontally on the surface of a base part.

In the above inventions (Inventions 1-3), the inclination angle of the plotting lines on the base part with respect to either of the sliding directions (vertical or horizontal direction) of the screen part is preferably 10 to 80° (Invention 4). If the inclination angle of the plotting lines is within the above range, the changes in the pattern can appear clearly when the screen part is slid either vertically or horizontally on the surface of the base part.

Secondly, the present invention provides a container with screen part, comprising a container body and a screen part capable of sliding vertically and/or horizontally on the surface of the container body, wherein a plurality of patterns comprising a plurality of plotting lines of a predetermined width drawn parallel to each other at fixed intervals and drawn inclined with respect to the sliding direction (vertical and/or horizontal direction) of the screen part are provided in staggered positions on the surface of the container body at intervals corresponding to the width of the plotting lines, and wherein a plurality of linear masking portions of a predetermined width alternating with a plurality of linear viewing portions of a predetermined width are provided parallel to each other on the screen part at an inclination angle corresponding to an inclination angle of the plotting lines on the container body (Invention 5).

In the container with screen part of the above invention (Invention 5), because the plotting lines of the pattern and the masking portions and viewing portions of the screen part are at an inclination angle with respect to the sliding directions (vertical and/or horizontal direction) of the screen part, a plurality of patterns can be sequentially displayed through the viewing portions of the screen part whether the screen part is slid in a vertical or horizontal direction on the surface of the container body. This container with screen part is interesting in changing patterns and very entertaining.

In the above invention (Invention 5), the container body may comprise a cylindrical portion, and the screen part may be provided on a cylindrical member attached to the outer circumference surface of the cylindrical portion of the container body so as to be able to slide in the circumferential direction and/or in the axial direction of the cylindrical portion of the container body (Invention 6).

With the above invention (Invention 6), a simple configuration allows a screen part to be slid vertically and/or horizontally on the surface of a container body. This also expands the scope of applications of the present invention since containers with cylindrical portions are widely used as drink containers and the like.

In the above invention (Invention 6), the cylindrical member may be formed from a heat-shrink film, and is capable of sliding in contact with the outer circumference surface of the cylindrical portion of the container body (Invention 7).

With the above invention (Invention 7), a further simple configuration allows a screen part to be slid vertically and/or horizontally on the surface of a container body, and the cylindrical member can be easily mounted on the container body by means of heat treatment.

In the above inventions (Inventions 5-7), the inclination angle of the plotting lines on the container body with respect to either sliding direction (vertical or horizontal direction) of the screen part is preferably 10 to 80° (Invention 8). If the inclination angle of the plotting lines is within the above range, the changes in the pattern can appear clearly when the screen part is slid either vertically or horizontally on the surface of the container body.

ADVANTAGEOUS EFFECT OF THE INVENTION

With the pattern display implement and container with screen part of the present invention the pattern can be changed in a different way from before, making it interesting in changing patterns and very entertaining. In particular, according to the container with screen part of the present invention, the desire of the consumer to purchase the contents of the container can be increased.

EXPLANATION OF REFERENCE NUMERALS

1 heat-shrink film (cylindrical member)
2 screen part
21 opaque portion (masking portion)
22 transparent portion (viewing portion)
3 can (container body)
4 pattern part
40*a*, 40*b*, 40*c*, 40*d*, 40*e* patterns
41*a*, 41*b*, 41*c*, 41*d*, 41*e* plotting lines
42 space

BEST MODE FOR CARRYING OUT THE INVENTION

Embodiments of the present invention are explained below.

Figure 1:
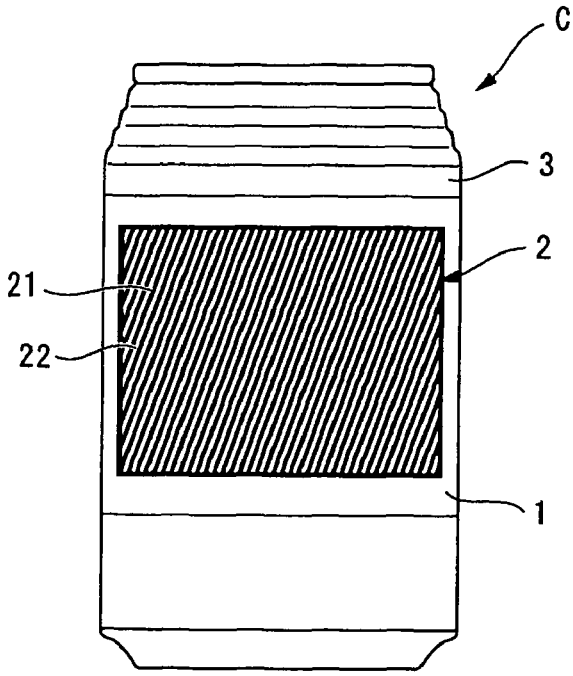
FIG. 1 is a side view of a container with screen part according to one embodiment of the present invention.
Figure 2:
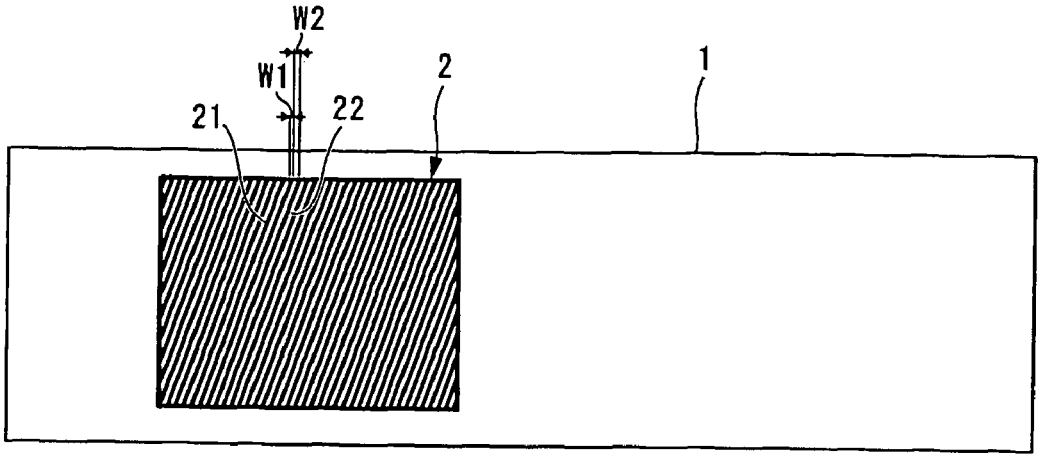
FIG. 2 is an expanded view of the heat-shrink film in the same embodiment.
Figure 3:
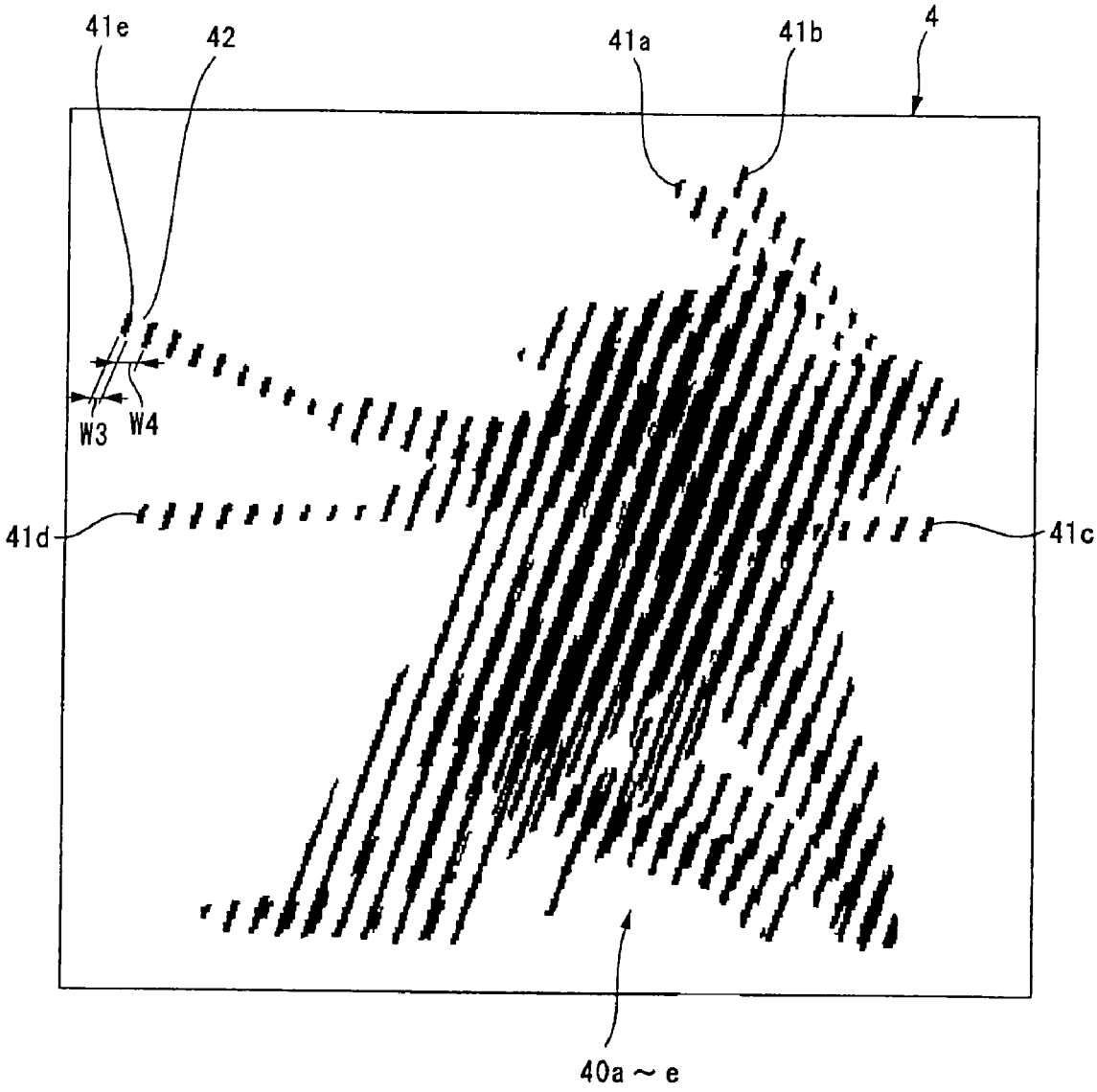
FIG. 3 shows a pattern part provided on the outer circumference surface of a can in the same embodiment.
Figure 4:
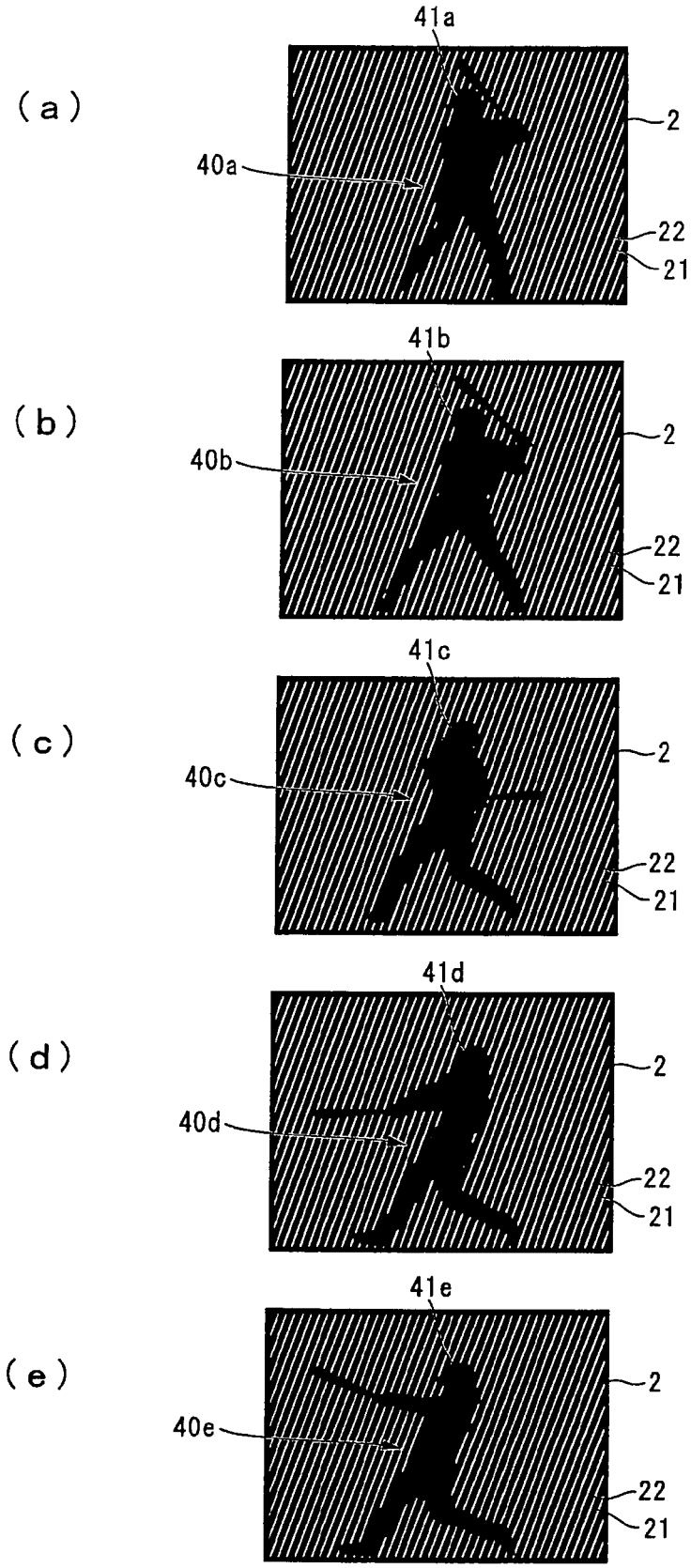
FIG. 4 shows changes in the pattern on the container with screen part of the same embodiment.

FIG. 1 is a side view of a container with screen part according to one embodiment of the present invention, FIG. 2 is an expanded view of the heat-shrink film in the same embodiment, FIG. 3 shows a pattern part provided on the outer circumference surface of a can in the present embodiment, and FIGS. 4(*a*) through 4(*e*) shows changes in the pattern on the container with the screen part of the present embodiment.

As shown in FIG. 1, the container with screen part C of the present embodiment comprises a can 3 as a container body and a heat-shrink film 1 as a cylindrical member mounted on the outer circumference surface of the cylindrical body of the can 3. The can 3 in the present embodiment is a drink can, but the type of container (use or material) is not particularly limited as long as it has a cylindrical portion.

A pattern part 4 described below is provided on the outer circumference surface of the can 3, and a screen part 2 described below is provided on the heat-shrink film 1.

To mount the heat-shrink film 1 on the can 3 as described above, the heat-shrink film 1 is formed as a cylinder with a predetermined height, and the heat-shrink film 1 is placed over the body of the can 3 while the screen part 2 of the heat-shrink film 1 is aligned with the pattern part 4 of the can 3, after which this is heated in a steam tunnel, hot air tunnel or other heating area to thermally shrink the heat-shrink film 1.

The material of the heat-shrink film 1 is not particularly limited as long as it can be mounted on the can 3 as described above and can function as the screen part 2 as described below. For example, films using biaxial oriented polystyrene films (OPS) and other polystyrene series resins and films using polyethylene terephthalate (PET) films and other polyester series resins can be used.

As shown in FIG. 2, the screen part 2 on the heat-shrink film 1 is provided with multiple linear opaque portions 21 (corresponding to the masking portions of the present invention) of width W1 alternating with and parallel to multiple linear transparent portions 22 (corresponding to the viewing portions of the present invention) of width W2 at an angle to the axial direction of the cylindrical heat-shrink film 1 (that is, the axial direction of the can 3). Such a screen part 2 can be obtained by printing the opaque portions 21 on the transparent heat-shrink film 1.

As shown in FIG. 3, a pattern part 4 is formed on the outer circumference surface of the can 3 in a position corresponding to the screen part 2 of the heat-shrink film 1. The pattern part 4 has multiple (five in the present embodiment) patterns 40*a* through 40*e*, and these patterns 40*a* through 40*e* are composed of multiple plotting lines 41*a* through 41*e* of width W3 arranged at an angle to the axial direction of the can 3 with spaces 42 of width W4 in between. The patterns 40*a* and 40*b*, the patterns 40*b* and 40*c*, the patterns 40*c* and 40*d* and the patterns 40*d* and 40*e* are each provided at staggered positions relative to each other, separated by spaces corresponding to the plotting lines 41*a* through 41*e* of width W3.

It is preferable that the width W1 of the opaque portion 21 of the screen part 2 be substantially the same as the width W4 of space 42 of pattern part 4, and that the width W2 of the transparent portion 22 of the screen part 2 be the same as or slightly smaller than the width W3 of the plotting line 41*a* through 41*e* of the pattern part 4, and it is also preferable that the width W1 of the opaque portion 21 of the screen part 2 and the width W4 of the space 42 of the pattern part 4 be equal to the width W3 of the line 41*a* through 41*e* of the pattern part 4 times the number of the patterns minus 1 (5−1 =4 in the present embodiment).

Specifically, the width W3 of the plotting line 41*a* through 41*e* in the pattern part 4 is preferably 0.1 to 1.0 mm, particularly preferably 0.3 to 0.7 mm. If the width W3 of the plotting line 41*a* through 41*e* of the pattern part 4 is in this range, each patterns 40*a* through 40*e* can be displayed clearly and dynamically.

Furthermore, the angle (angle with respect to axis of the can 3; the same hereinafter) of the opaque portions 21 and the transparent portions 22 on the screen part 2 are preferably substantially the same as the angle of the plotting lines 41*a* through 41*e* of the pattern part 4, and this angle is preferably 10 to 80°, particularly preferably 20 to 70°.

With the screen part 2 and the pattern part 4 configured in the above way, the transparent portions 22 of the screen part 2 will display the plotting lines 41*a* through 41*e* of any one of the patterns 40*a* through 40*e* of the pattern part 4, while the opaque portions 21 of the screen part 2 will conceal the plotting line 41*a* through 41*e* of the remaining four patterns 40*a* through 40*e* of the pattern part 4. Moreover, when the heat-shrink film 1 is slid in the circumferential direction of the can 3 at intervals corresponding to the width W3 of the plotting lines 41*a* through 41*e* of the pattern part 4, the multiple patterns 40*a* of 40*e* of the pattern part 4 will be exposed one after another through the transparent portions 22 of the screen part 2. In the same way, when the heat-shrink film 1 is slid in the axial direction of the can 3 at intervals corresponding to the width W3 of the plotting line 41*a* through 41*e* of the pattern part 4, the multiple patterns 40*a* through 40*e* of the pattern part 4 are exposed one after another through the transparent portions 22 of the screen part 2.

Specifically, when the heat-shrink film 1 is slid clockwise around the circumference of the can 3 at intervals corresponding to the width W3 of the plotting line 41*a* through 41*e* of the pattern part 4, or when the heat-shrink film 1 is slid upwards in the axial direction of the can 3 at intervals corresponding to the width W3 of the plotting line 41*a* through 41*e* of the pattern part 4, five patterns 40*a* through 41*e* will be exposed one after the other through the transparent portions 22 of the screen part 2 as shown in FIGS. 4(*a*) through 4(*e*) to dynamically reveal a scene of a batter swinging.

Note that, when the angle of the opaque portions 21 and the transparent portions 22 of the screen part 2 and the angle of the plotting lines 41*a* through 41*e* of the pattern part 4 is less than 10°, it is difficult for the change in pattern to appear clearly when the heat-shrink film 1 is slid in the axial direction of the can 3, while if these angles exceed 80°, it is also difficult for the change in pattern to appear clearly when the heat-shrink film 1 is slid in the circumferential direction of the can 3.

The container with screen part C such as that described above is interesting in changing patterns and very entertaining because the pattern that appears on the screen part 2 can be changed by sliding the heat-shrink film 1 either in the circumferential direction of the can 3 or in the axial direction of the can 3. According to this container with screen part C, it is possible to increase the desire of a consumer to purchase the contents (a drink in the present embodiment) of the can 3.

The above embodiments have been described for facilitating understanding of the present invention, and not for limiting the present invention. The various elements described in the above embodiments are thus deemed to also include all design modifications and equivalents falling under the technical scope of the present invention.

For example, a PET bottle or other bottle having a cylindrical portion could be used instead of the aforementioned can 3, or another kind of base material having a cylindrical or columnar part (corresponding to the pattern display implement of the present invention) could be used instead of a container. Moreover, a cylindrical plastic member or cylindrical metal member or the like with openings corresponding to the transparent portions 22 of the screen part 2 could be used in place of the heat-shrink film 1.

A separately prepared cylindrical or columnar base material provided with a cylindrical member having a screen part could also be mounted over or imbedded in the above can 3, and thus the pattern display implement could be constructed separately from the can 3.

Moreover, in the present invention the pattern part 4 can be provided on a flat part of a container or the like having a flat part, and the screen part 2 can be fixed in a predetermined frame and the frame is supported by a coil spring or rubber or other elastic member in a floating state so as to allow the frame to move vertically or horizontally on the flat part.

The patterns appearing on the screen part 2 are not limited to changing shape due to the slide of the heat-shrink film 1, and they may also change color or both shape and color. In this case, the exposed color may change because the colors of patterns 40*a* through 40*e* are different, or the exposed color may be altered by combining the colors of the pattern part 4 with color of the colored transparent portions 22 of the screen part 2.

INDUSTRIAL APPLICABILITY

The pattern display implement of the present invention is useful as a toy or the like. Furthermore, the container with screen part of the present invention is useful for promoting sales of the contents of the container because the container increases a consumer's desire to purchase the contents with its entertaining.

The invention claimed is:

1. A pattern display implement comprising:

a base part and a screen part, the screen part sliding separately in both vertical and horizontal directions on a surface of the base part, wherein:

a plurality of patterns comprising a plurality of plotting lines of a predetermined width, which are parallel to each other at predetermined intervals, are inclined with respect to the sliding directions of the screen part, and are provided in staggered positions on the surface of the base part at intervals corresponding to the width of the plotting lines, a plurality of linear masking portions of a predetermined width alternating with a plurality of linear viewing portions of a predetermined width are provided parallel to each other on the screen part at an inclination angle corresponding to an inclination angle of the plotting lines on the base part, and the plurality of patterns are sequentially displayed through the viewing portions of the screen part when the screen part is slid with respect to the base part in a vertical direction on the surface of the base part and when the screen part is slid with respect to the base part in a horizontal direction on the surface of the base part.

2. The pattern display implement according to claim 1, wherein:

the base part is cylindrical or columnar and has an outer circumferential surface, and the screen part is provided on a cylindrical member which is attached to the outer circumferential surface of the base part so as to be able to slide in a circumferential direction and in an axial direction of the base part.

3. The pattern display implement according to claim 2, wherein the cylindrical member is formed from a film and is capable of sliding in contact with the outer circumferential surface of the base part.

4. The pattern display implement according to any one of claims 1 through 3, wherein the inclination angle of the plotting lines on the base part with respect to the vertical sliding direction of the screen part is 10 to 80°, and the inclination angle of the plotting lines on the container body with respect to the horizontal sliding direction of the screen part is 10 to 80°.

5. A container with screen part, comprising:

a container body and a screen part,the screen part sliding separately in both vertical and horizontal directions on a surface of the container body, wherein:

a plurality of patterns comprising a plurality of plotting lines of a predetermined width that are parallel to each other at fixed intervals, inclined with respect to the sliding direction of the screen part, and formed in staggered positions on the surface of the container body at intervals corresponding to the width of the plotting lines, and a plurality of linear masking portions of a predetermined width alternating with a plurality of linear viewing portions of a predetermined width are provided parallel to each other on the screen part at an inclination angle corresponding to an inclination angle of the plotting lines on the container body, and the plurality of patterns are sequentially displayed through the viewing portions of the screen part when the screen part is slid with respect to the container body in a vertical direction on the surface of the container body and when the screen part is slid with respect to the container body in a horizontal direction on the surface of the container body.

6. The container with screen part according to claim 5, wherein:

the container body comprises a cylindrical portion, which has an outer circumferential surface, and the screen part is provided on a cylindrical member attached to the outer circumferential surface of the cylindrical portion of the container body so as to be able to slide in a circumferential direction and in an axial direction of the cylindrical portion of the container body.

7. The container with screen part according to claim 6, wherein the cylindrical member is formed from a heat-shrink film, and is capable of sliding in contact with the outer circumferential surface of the cylindrical portion of the container body.

8. The container with screen part according to any one of claims 5 to 7, wherein the inclination angle of the plotting lines on the container body with respect to the vertical sliding direction of the screen part is 10 to 80°, and the inclination angle of the plotting lines on the container body with respect to the horizontal sliding direction of the screen part is 10 to 80°.

9. A pattern display implement comprising:

a cylindrical base part and a cylindrical screen part, the screen part being fitted to the base part and sliding separately in both a first direction and a second direction on a surface of the base part, wherein:

the first direction is an axial direction of the cylindrical base part, and the second direction is a circumferential direction about an axis of the cylindrical base part, a plurality of patterns including a plurality of plotting lines of a predetermined width, which are parallel to each other at predetermined intervals, are inclined by a first inclination angle with respect to the first direction and by a second inclination angle with respect to the second direction, and the plotting lines are provided in staggered positions on the surface of the base part at intervals that correspond to the width of the plotting lines, and a plurality of linear masking portions of a predetermined width alternating with a plurality of linear viewing portions of a predetermined width are provided parallel to each other on the screen part and are inclined by the first inclination angle with respect to the first direction and by the second inclination angle with respect to the second direction, and the plurality of patterns are sequentially displayed through the viewing portions of the screen part to create the appearance of motion when the screen part is slid with respect to the base part in the first direction on the surface of the cylindrical base part and when the screen part is slid with respect to the base part in the second direction on the surface of the base part.

10. The pattern display implement according to claim 9, wherein the cylindrical screen part is formed by a film and is capable of sliding in contact with an outer circumferential surface of the base part.

11. The pattern display implement according to claim 9, wherein the first and second inclination angles are 10 to 80°.

12. The pattern display implement according to claim 9, wherein a diameter of the screen part is uniform in an axial direction of the screen part.

* * * * *